US006880725B2

(12) United States Patent
De Laforcade

(10) Patent No.: US 6,880,725 B2
(45) Date of Patent: Apr. 19, 2005

(54) DEVICE FOR DISPENSING SEPARATELY PACKAGED PRODUCTS TOGETHER

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 137 days.

(21) Appl. No.: 10/263,702

(22) Filed: Oct. 4, 2002

(65) Prior Publication Data

US 2003/0121936 A1 Jul. 3, 2003

(30) Foreign Application Priority Data

Oct. 4, 2001 (FR) ..... 01 12777

(51) Int. Cl.[7] ..... B65D 35/22

(52) U.S. Cl. ..... 222/94; 222/105; 222/83; 222/145.1

(58) Field of Search ..... 222/94–95, 136, 222/211–213, 153.1–153.05, 153.07, 153.14, 83, 83.5, 145.3, 81, 85, 105, 107, 145.1, 145.5

(56) References Cited

U.S. PATENT DOCUMENTS

| | | | | | |
|---|---|---|---|---|---|
| 2,973,883 | A | * | 3/1961 | John | 222/94 |
| 3,221,917 | A | * | 12/1965 | De Santo et al. | 220/502 |
| 3,608,782 | A | * | 9/1971 | Sathicq | 222/94 |
| 3,802,604 | A | * | 4/1974 | Morane et al. | 222/83 |
| 4,099,651 | A | * | 7/1978 | von Winckelmann | 222/94 |
| 4,402,700 | A | * | 9/1983 | Feinland et al. | 8/416 |
| 5,277,303 | A | * | 1/1994 | Goyet et al. | 206/221 |
| 5,370,270 | A | * | 12/1994 | Adams et al. | 222/88 |
| 5,482,177 | A | * | 1/1996 | Keller | 220/278 |
| 5,647,481 | A | * | 7/1997 | Hundertmark et al. | 206/219 |
| 5,697,524 | A | * | 12/1997 | Sedlmeier | 222/82 |
| 6,012,610 | A | * | 1/2000 | Pauser et al. | 222/88 |
| 6,065,643 | A | * | 5/2000 | Harvey et al. | 222/94 |
| 6,082,588 | A | * | 7/2000 | Markey et al. | 222/137 |
| 6,126,045 | A | * | 10/2000 | Last | 222/501 |
| 6,398,077 | B1 | * | 6/2002 | Gross et al. | 222/145.1 |
| 6,412,659 | B1 | * | 7/2002 | Kneer | 222/82 |
| 6,719,729 | B1 | * | 4/2004 | Sogaro | 604/191 |

FOREIGN PATENT DOCUMENTS

| | | |
|---|---|---|
| WO | WO 93/08117 | 4/1993 |
| WO | WO 99/05446 | 2/1999 |

* cited by examiner

*Primary Examiner*—Frederick Nicolas
(74) *Attorney, Agent, or Firm*—Finnegan, Henderson, Farabow, Garrett & Dunner, LLP

(57) ABSTRACT

A device for dispensing a first product and a second product together comprising a first container configured to contain the first product and a second container configured to contain the second product. The device may further comprise a dispensing member defining at least one dispensing orifice, the dispensing member being movable so as to irreversibly switch the device from a first configuration to a second configuration. When the device is in the first configuration, the first container and the second container are not in flow communication with the at least one dispensing orifice, and when the device is in the second configuration, the first container and the second container are in flow communication with the at least one dispensing orifice.

47 Claims, 8 Drawing Sheets

DEVICE FOR DISPENSING SEPARATELY PACKAGED PRODUCTS TOGETHER

The present invention relates to a unit for packaging two products separately and dispensing them together as a mixture, such as a mixture in the form of a cosmetic composition, as used for example in the field of hair coloring, skin care, and other cosmetic applications.

In the field of hair coloring, the preparation of some coloring compositions may entail the extemporaneous mixing of two products (e.g., a colorant and an oxidizer) which, for reasons of stability, may be desirable to maintain separate from one another until the time that the coloring composition is to be used.

The last few years have seen the emergence, for example, in the field of hair coloring, of mixing devices that allow, fairly "automatically," two products to be packaged separately and mixed extemporaneously at the time that the products are to be used. Such systems may be expensive and/or complicated to produce. The seals between the two compartments containing each of the products are sometimes difficult to achieve. Furthermore, it may be difficult to find materials for the dispenser that are compatible with the compounds that are to be packaged because of the highly aggressive nature of at least some of them.

There are also systems which may work "manually" rather than "automatically" and in which each of the products to be mixed may be packaged in its own packaging, such as in the form of a tube or a sachet, for example. To mix the mixture, the consumer may tip the contents of one of the packagings into the other, or the contents of both packagings into a third, inside which mixing may then be performed.

All these operations may prove difficult. There may be a risk that the consumer will become soiled when handling the products. There also may be a risk that the consumer may incorrectly meter the products and be tempted to use the amounts needed for a single application for two or more applications. This then results in a hair coloration, or other cosmetic appearance or result, which is not as the user desires or expects.

Hence, it may be desirable to produce a device for packaging two products separately and dispensing them together, which may fully or partially solve the problems mentioned hereinabove with reference to the conventional systems discussed above.

A desirable aspect may be to produce such a device which is simple to use and can be produced at a low cost price.

Another desirable aspect may be to produce such a device which limits the risks of incorrect use and which thereby reduces the risks of obtaining a mixture having properties which may be neither desired nor expected.

It should be understood that the invention could be practiced without having one or more features of any objects, aspects, or embodiments described herein. In addition, such features are exemplary and at least some of them are set forth in the detailed description which follows.

As embodied and broadly described herein, one aspect of the invention includes a device for dispensing a first product and a second product together, the device comprising a first container configured to contain the first product and a second container configured to contain the second product. The device may further comprise a dispensing member defining at least one dispensing orifice and being movable so as to irreversibly switch the device from a first configuration to a second configuration. When the device is in the first configuration, the first container and the second container are not in flow communication with the at least one dispensing orifice, and when the device is in the second configuration, the first container and the second container are in flow communication with the at least one dispensing orifice.

In one exemplary embodiment, when the device is in the second configuration, the first and second products may be dispensed together in response to pressure exerted on walls, for example flexible walls, of the first and second containers, which may be arranged adjacent to one another.

The joint delivery of the first and second products with a view to producing a mixture, such as a cosmetic composition, may be via a single dispensing orifice upstream of which there may be a mixing zone in which the two products are brought into contact before being dispensed in at least partially mixed form.

The term "irreversible" is used herein to mean that return from the second configuration to the first configuration is made impossible regardless of how the dispensing member is handled during normal use. Although it may be possible to cause the dispensing member to move in a manner opposite to that of the movement which switches the device from the first configuration to the second configuration, this reverse movement should have no effect on the flow communication between the dispensing orifice and the first and second containers and should therefore not cause the device to return to the first configuration.

In an alternative exemplary embodiment, the device may comprise two or more dispensing orifices arranged adjacent each other and each of the products may leave via a respective dispensing orifice. In this case, the two products may be brought into contact directly on the surface that is to be treated and the dispensing member may be used as an applicator nozzle. Or, the two products may be brought into contact with each other in an auxiliary container in which the mixture can be homogenized manually. The choice of which configuration to employ may be related to such factors as the viscosity of the products, and/or on their ability or inability to mix rapidly, and/or on the application for which the products are to be used, for example.

Because the switch from the first configuration to the second configuration is irreversible, the risk that a consumer may use just part of the contents of the device may be minimized. This is because once the device is in the second configuration, it may be difficult to envision the device to be used in a manner other than in the context of a single use dispensing device.

In yet another exemplary embodiment, at least one of the first container and the second container comprises at least one-flexible wall. Further, the first container and the second container may be flexible-wall containers. For example, the second container may be external to (i.e., not positioned inside of) the first container, and the first container may be external to the second container.

In another aspect, the device may comprise a mounting member on which the first container and the second container are mounted. The dispensing member may be moveable with respect to the mounting member.

The single mounting member on which the two containers may be mounted may allow the two containers to be opened in the same action by a relatively simple movement of the dispensing member relative to the mounting member, such as, for example, pushing the dispensing member in axially and/or turning the dispensing member.

According to an exemplary embodiment, the first and second containers may be in the form of sachets. The two containers, when they are in the form of sachets, may each be formed by joining (e.g., welding) two sheets together along their peripheral edges, for example. In one example, two sachets may be arranged with a first main face of the first sachet in contact (or practically in contact) with a second main face of the second sachet. The first and second faces may face one another directly or be separated by a separating means in the form of a thin plate.

According to an exemplary embodiment, to dispense the two products together, pressure may be exerted simultaneously on the flexible walls of the two containers so as to force the two products to leave jointly through the dispensing orifice or orifices. For this purpose, the mounting member may be configured in such a way that the containers, for example when they are in the form of relatively thin sachets, are superposed such that the two sachets may be compressed, for example with a single hand, so as to expel their contents.

Alternatively, two plates or other similar grasping surfaces, arranged on each side of the superposed pair of sachets may be used to make it easier to expel together the two products contained in each of the containers. Such plates may have dimensions similar to those of the sachets.

In yet another exemplary embodiment, the dispensing member may comprise a first portion and a second portion configured, in response to movement of the dispensing member, such as an axial movement, for example, to move a first closure element associated with the first container and a second closure element associated with the second container so as to place the first and second containers in flow communication with the dispensing orifices. The device may be configured so that the moving of the first closure element and the second closure element occurs in a unidirectional manner. In addition, the first portion and the second portion may engage the first closure element and the second closure element, respectively, so as to move the closure elements. The engagement of the first and second portions with the first and second closure elements also may be unidirectional. For example, assuming that the dispensing member can move in the opposite direction as the direction for moving the first and second closure elements, such a movement may have no effect on the closure elements because engagement is merely unidirectional.

The first and second closure elements may be situated well upstream of the at least one dispensing orifice and associated with first and second inlet/outlet, flow passages of the first and second containers.

According to yet another aspect, the dispensing member may comprise a first tubular element defining a first flow passage in flow communication with the dispensing orifice and a first free end defining the first portion, and the dispensing member may also comprise a second tubular element defining a second flow passage in flow communication with the dispensing orifice and a second free end defining the second portion. The first free end and the second free end may be crenellated. The tubular elements may have lengths sufficient to engage with the closure elements, which may be arranged inside their respective containers.

The crenellated free ends may encourage flow communication between the first and second containers and the at least one dispensing orifice when the device is in the second configuration. This feature may be desired, for example, as will be described later, when the closure elements are coupled to connecting strips having intrinsic elasticity which tends to return them to a position corresponding to the first configuration of the device.

In yet another exemplary embodiment, the dispensing member and the mounting member may be configured to cooperate with one another, for example by a locking mechanism provided on the dispensing member configured to cooperate with a corresponding mechanism on the mounting member, so as to immobilize the dispensing member at least axially relative to the mounting member when the device is in the second configuration. This may be desirable in that it may help to ensure the irreversibility of the switching of the device from the first to the second configuration. It also may be desirable when the irreversibility is afforded by unidirectional engagement of the first and second portions of the dispensing member and the closure elements. That is, without such locking, the dispensing member may be detached from the remainder of the device. This in turn may make the device difficult to handle with a view to dispensing the two products together.

The device may further comprise a tamper indicator for indicating tampering with the device. The tamper indicator may comprise a non-repositionable element, such as a tear-off strip, or the like, for example. Thus, as long as the tamper indicator has not been removed, the dispensing member may not be moveable, for example, with respect to the mounting member, so as to place the first and second containers in flow communication with the dispensing orifice.

In yet another exemplary embodiment, the first container comprises a first flow passage through which the first product is configured to flow during dispensing and the second container comprises a second flow passage through which the second product is configured to flow during dispensing. The first closure element may be configured to close the first flow passage and the second closure element may be configured to close the second flow passage when the device is in the first configuration.

According to an aspect, the first closure element and the second closure element may each comprise a coupling mechanism configured so that, prior to mounting the dispensing member to the device, the coupling mechanism is capable of engaging with a tool for moving the first closure element and the second closure element from a position in which the first container and the second container are in flow communication with the exterior of the device to a position in which the first container and the second container are not in flow communication with (i.e., are isolated from) an exterior of the device. The tool may comprise a product filling tool having portions configured to be introduced into the first flow passage and the second flow passage. The coupling mechanism may be part of a snap-fastening mechanism or other similar coupling mechanism. In this way, the coupling mechanism may make it possible, after filling, for example, for the flow passages to be closed by the closure elements before the dispensing member is fitted onto the remainder of the device.

As an example, after filling, the filling tool, during its withdrawal movement, may carry the closure elements into the position in which they isolate (i.e., prevent flow communication of) the first and second containers from the outside.

In an exemplary aspect, the first container and the second container are formed of at least one layer of a material chosen from a thermoplastic material and a metallic material, or other suitable material. For example, the first and second containers may be in the form of sachets having at least one wall formed of a thermoplastic or metallic material. The sachets may have an approximately rectangular shape, for example. By way of example, their length may be of the order of 10 cm and their width may be of the order of 5 cm.

According to yet another aspect, the device may further comprise a first insert configured to be inserted into the first container and a second insert configured to be inserted into the second container. The first insert may define a first flow passage configured to flow the first product from the first container during dispensing and the second insert may define a second flow passage configured to flow the second product from the second container during dispensing.

The first insert may further comprise the first closure element configured to prevent flow communication between the first container and the dispensing orifice when the device is in the first configuration and the second insert may further comprise the second closure element configured to prevent flow communication between the second container and the dispensing orifice when the device is in the first configuration.

According to an aspect, the first closure element and the second closure element may be configured to close the first flow passage and the second flow passage when the device is in the first configuration. The first closure element may be connected to the first insert and the second closure element may be connected to the second insert. As an example, the device may comprise a first connecting strip configured to connect the first closure element to the first insert and a second connecting strip configured to connect the second connecting strip to the second insert. Such connecting strips may be used during filling when it may be desired to be able, prior to filling, to remove the closure elements and then to be able to put them back in place after filling.

In an exemplary embodiment, the first container and the second container may be mounted on the first insert and the second insert, respectively, by one of bonding and welding.

According to an exemplary aspect, the first and second flow passages of the first and second containers and their associated closure elements may be formed by first and second inserts mounted, particularly by snap-fastening, screw fastening, or other suitable closure mechanisms, on the mounting member. An example of one type of insert that may be used is described in PCT International Publication No. WO 99/105446.

In another exemplary embodiment, the device further comprises the first product in the first container and the second product in the second container. By way of example, the first product may comprise a first constituent component of a cosmetic composition, and the second product may comprise a second constituent component of a cosmetic composition. The mixture of the first product and the second product may comprise a cosmetic composition.

According to an exemplary embodiment, the first product may comprise an oxidizer, the second product may comprise a colorant, and the cosmetic composition may comprise a hair coloring composition.

According to yet another aspect, after the device has been switched from the first configuration to the second configuration, further movement of the dispensing member does not alter (i.e., terminate or vary) the flow communication between the dispensing orifice and the first container and the second container.

According to yet another exemplary embodiment, the invention may include a device for dispensing a first product and a second product together comprising a first flexible-walled container configured to contain the first product and a second flexible-walled container external to the first container and configured to contain the second product. The device may further comprise a mounting member configured to be mounted to the first container and the second container and a dispensing member defining at least one dispensing orifice. The dispensing member may be movable so as to irreversibly switch the device from a first configuration to a second configuration. When the device is in the first configuration, the first container and the second container are not in flow communication with the at least one dispensing orifice, and when the device is in the second configuration, the first container and the second container are in flow communication with the at least one dispensing orifice.

According to another exemplary embodiment, the invention includes a method of dispensing a first product and a second product comprising providing any of the dispensing devices described herein, wherein the first product is in the first container and the second product is in the second container, and moving the dispensing member so as to switch the device from the first configuration to the second configuration. The method may further comprise flowing the first product and the second product from the first container and the second container, respectively, and out of the at least one dispensing orifice.

The term "providing" used herein is used broadly and may refer to, but is not limited to, making available for use, giving, supplying, obtaining, getting a hold of, acquiring, purchasing, selling, distributing, possessing, making ready for use, and/or placing in a position ready for use.

Yet another aspect of the method may comprise at least partially mixing together the first product and the second product.

The method may further comprise applying the first product and the second product to an external body portion. The method may further comprise at least partially mixing together the first product and the second product prior to the applying of the first product and the second product.

The external body portion may comprises at least one of hair and skin.

In one example, the first product comprises a colorant and the second product comprises an oxidizer and the external body portion is hair. The method may further comprise at least partially mixing the first product and the second product together to form a hair coloring composition prior to applying the first product and the second product to the external body portion.

In an exemplary aspect, the moving may further comprise moving a first closure element associated with the first container and moving a second closure element associated with the second container. The moving of the first closure element and the second closure element may comprise moving the first closure element and the second closure element in a unidirectional manner.

In yet another exemplary aspect, the moving of the first closure element and the second closure element may comprise moving the first closure element and the second closure element from a first position in which the first and second closure elements prevent flow communication between the dispensing orifice and the first container and the second container, to a second position in which the first and second closure elements place the dispensing orifice in flow communication with the first container and the second container.

Aside from the structural and procedural arrangements set forth above, the invention could include a number of other arrangements, such as those explained hereinafter. It is to be understood that both the foregoing description and the following description are exemplary.

The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a schematic perspective view of an exemplary embodiment of a dispensing device according to an aspect of the invention;

Reference will now be made in detail to exemplary embodiments, examples of which are illustrated in the accompanying drawings. Wherever possible, the same reference numbers are used in the drawings and the description to refer to the same or like parts.

Figure 1:
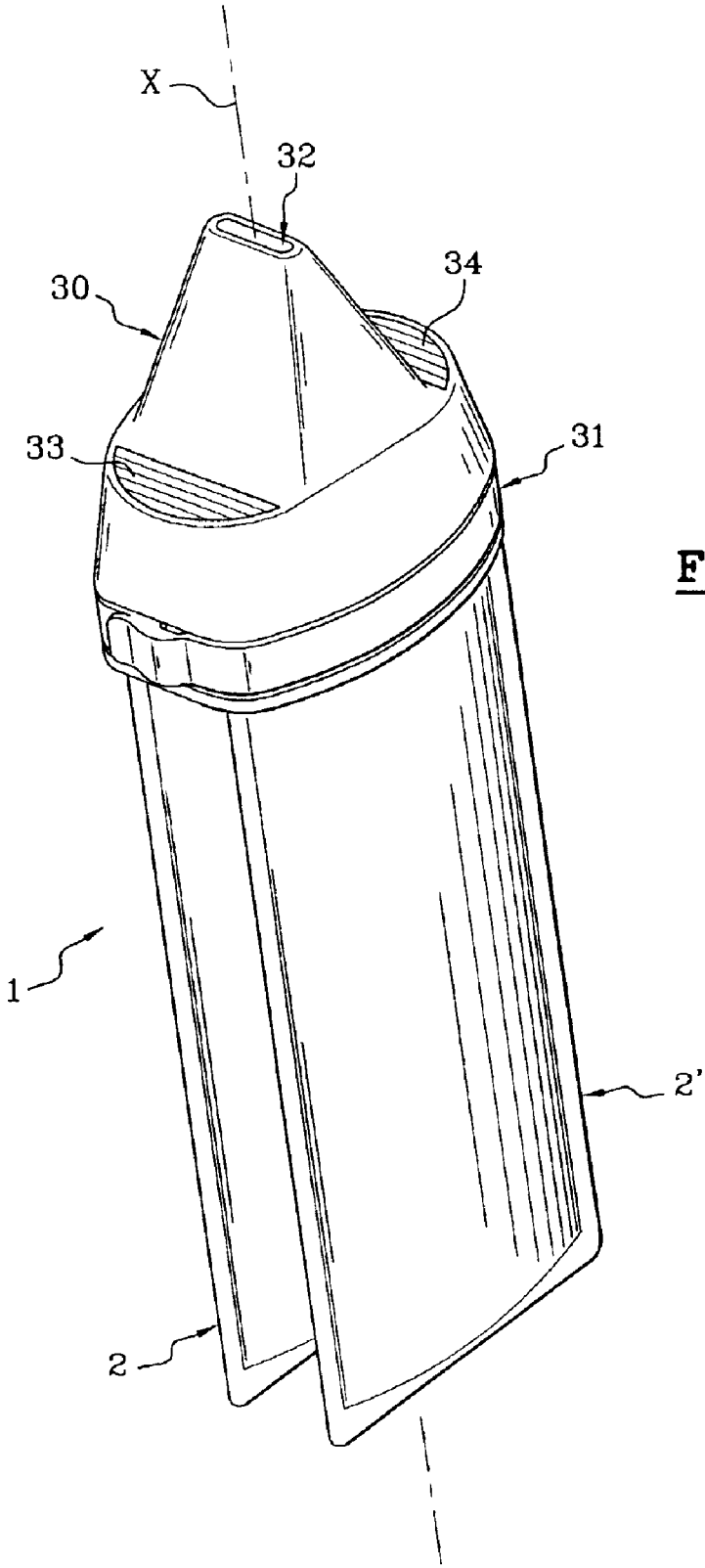
Figure 2:
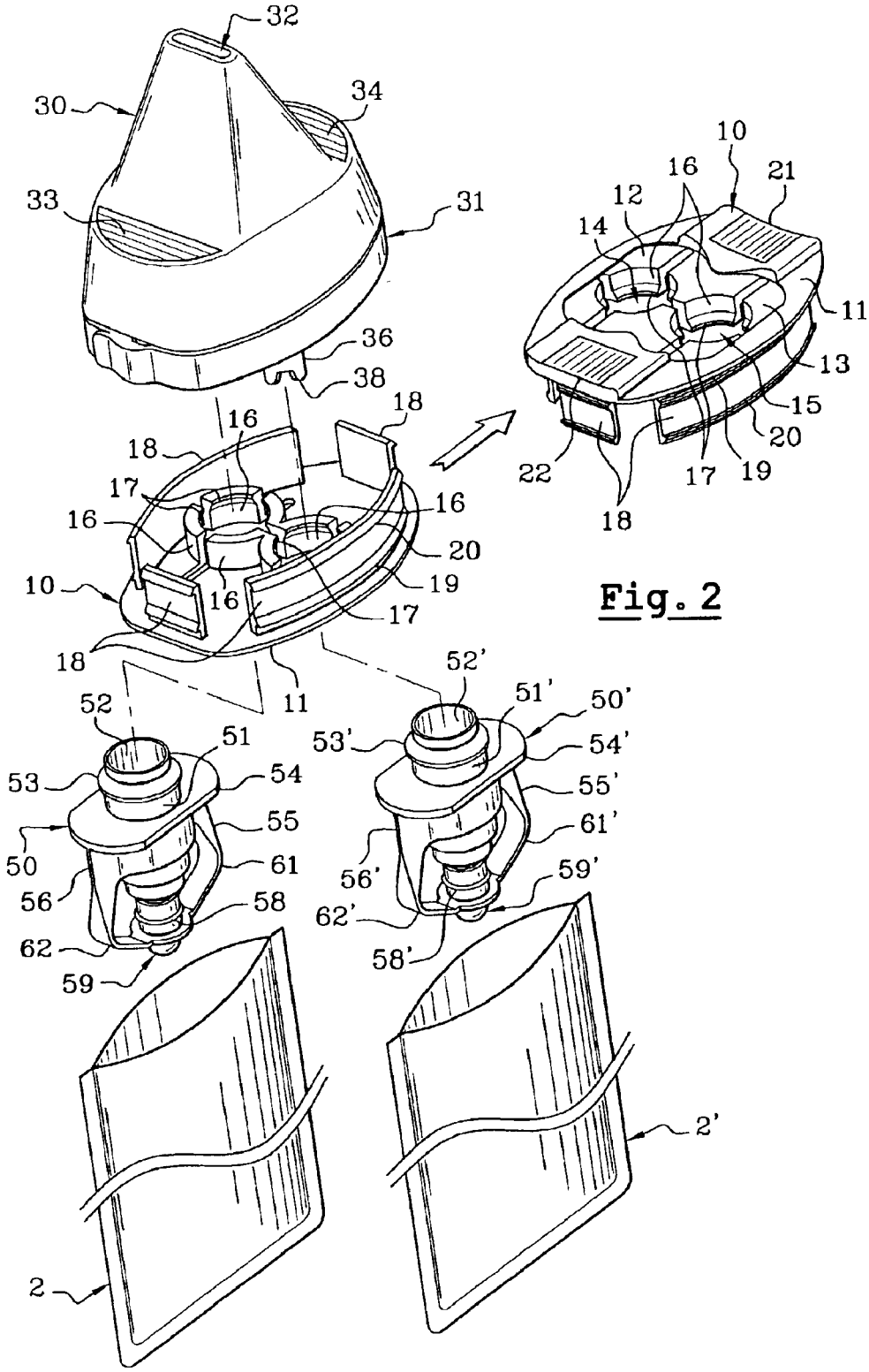
FIG. 2 is an exploded perspective view of the device of FIG. 1 in an unassembled state.

A device 1, of axis X, depicted in perspective views in FIGS. 1 and 2 and in sectional views in FIGS. 3A–3B and 4A–4B, may comprise two substantially identical containers, for example in the form of sachets 2, 2', arranged one beside the other and mounted on a mounting member 10.

The first sachet 2 may contain a first product, for example, an oxidation colorant. The second sachet 2' may contain a second product, for example an oxidizer.

A dispensing member 30 may be associated with (for example, arranged on) the mounting member 10. The dispensing member 30 may comprise a tamper-proofing strip 31 that has to be removed prior to first use. The dispensing member 30 may comprise a dispensing orifice 32. The dispensing orifice 32 may have a substantially elongate cross section.

The sachets 2 and 2' may be formed by the superposition of two substantially identical sheets and by welding the sheets along their bottom and their two longitudinal edges, for example. The opposite end to the bottom of each of the sachets may be closed by an insert 50, 50' which may be bonded or welded between the two sheets defining each of the sachets 2 and 2'. The sheets forming the sachets may be formed from an aluminum and plastic complex that can be fusion bonded to itself, for example, or other suitable materials.

The insert 50 may be made of a single thermoplastic component obtained by injection molding, for example, however other suitable materials may be used for the insert 50.

The insert 50 may comprise a cylindrical skirt 51 inside which an axial passage 52 is formed. The exterior surface of the cylindrical skirt 51, near the upper end of the insert 50, may comprise a catching bead 53. All around the cylindrical skirt 51, such as in the upper quarter of the height of the insert 50, for example, a transverse wall 54 of substantially rectangular shape with two rounded ends may be formed. Under the wall 54, the cylindrical skirt 51 may be connected to two flanges 55, 56, both arranged in substantially the same plane which contains the longitudinal axis of the insert 50. The thickness of the flanges 55 and 56 may decrease gradually away from the skirt 51.

Near its lower end, the cylindrical skirt 51 may have a smaller cross section on its interior surface, the skirt 51 may define an annular groove 57 able to cooperate by snap-fastening with an annular bead 58 formed on an exterior surface of a closure element, for example in the form of a hollow stopper 59, intended to be inserted in the axial passage 52 so as to plug it. The internal surface of the stopper 59 also may comprise an annular groove 60 whose function will be explained in detail later. The stopper 59 may be connected by two flexible connecting strips 61 and 62 to each of the flanges 55 and 56 of the insert 50.

The insert 50' is identical to the insert 50 and it will not therefore be described again. The numerical references allocated to the insert 50' are those allocated to the insert 50 with a "prime" (') added.

Figure 3A:
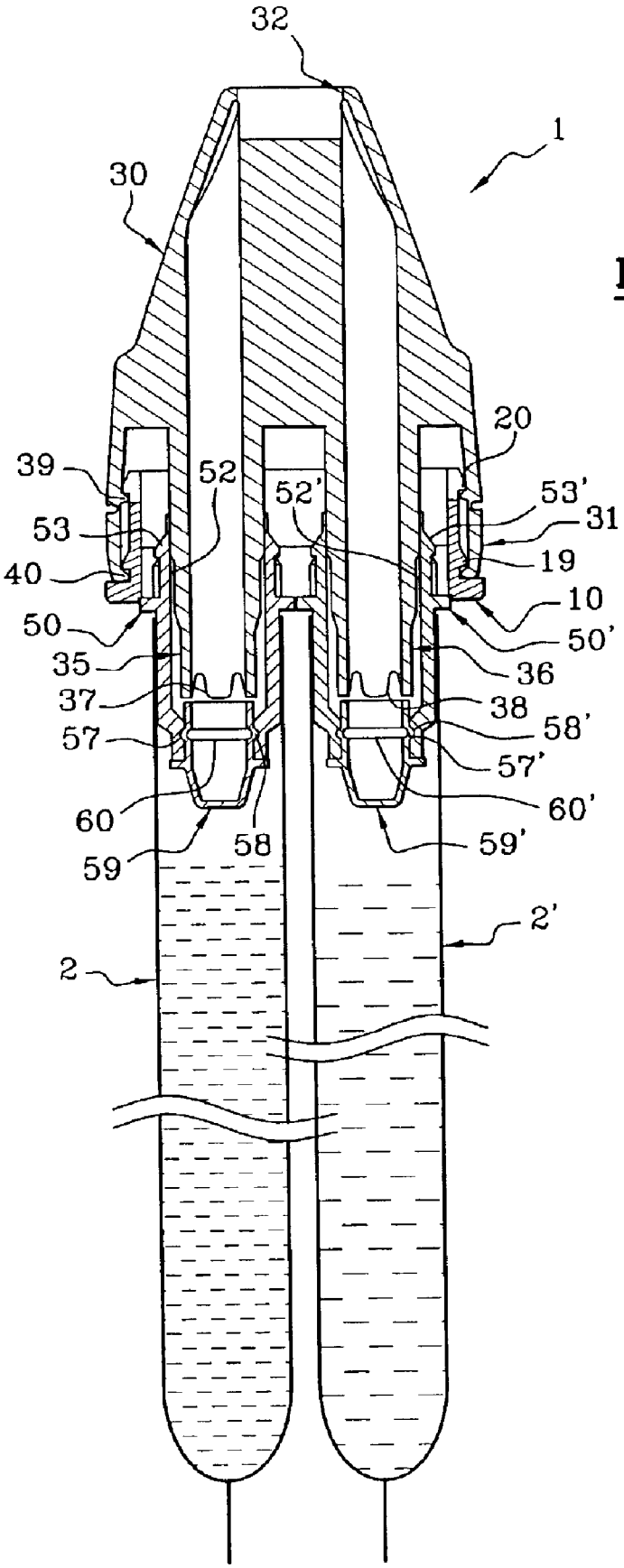
FIG. 3A is a schematic sectional view of the device of FIG. 1 in the storage position.
Figure 3B:
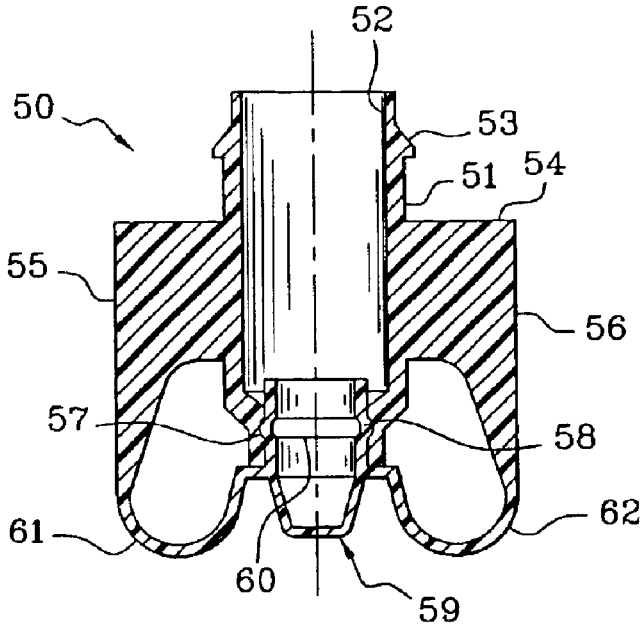
FIG. 3B is a partial sectional view of a portion of the device of FIG. 1 in the storage position.
Figure 4B:
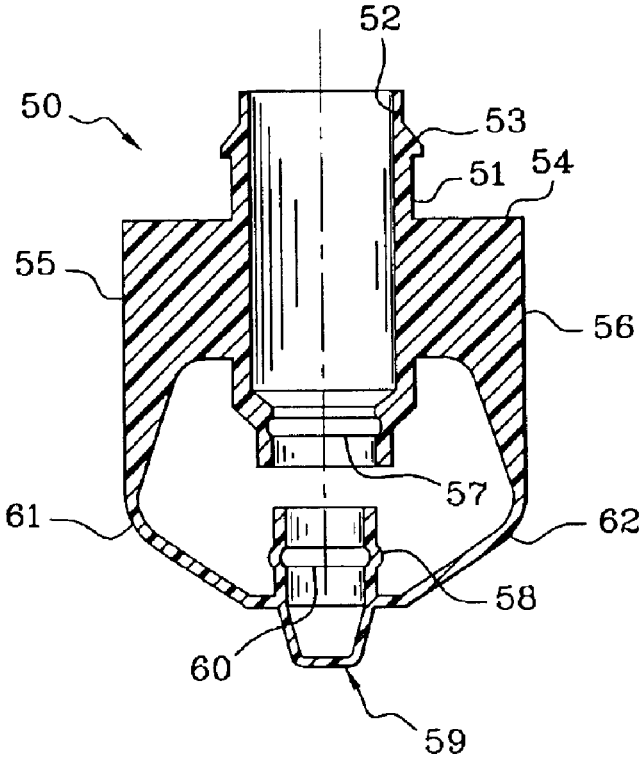
FIG. 4B is a partial sectional view of the portion of FIG. 3B in the dispensing position.

A sectional view of the inserts 50, 50' in their closed position (i.e., the first configuration) is shown in FIG. 3B. A sectional view of the inserts in their open position (i.e., second configuration) is shown in FIG. 4B.

In FIG. 2, the inserts 50 and 50' are depicted in their open position.

The mounting member 10, which may be of roughly rectangular cross section, may comprise a transverse wall 11 on one surface of which are formed two depressions 12 and 13 of a shape corresponding substantially to the shape of the transverse walls 54 and 54' of the inserts 50 and 50'. The wall 11 may have, passing through the center of each of the depressions 12 and 13, a passage 14 and 15 delimited by four skirt portions 16 substantially in the form of arcs of a circle, for example. The interior surface of the skirt portions 16 may form, on the opposite side to the wall 11, a catching bead 17 able to cooperate by snap-fastening with the beads 53 and 53' of the inserts 50 and 50'.

On the same side as the passages 14 and 15, the transverse wall 11 of the mounting member 10 may be bordered by four skirt portions 18 which, as will be seen later, serve to attach the dispensing member 30. For this purpose, each skirt portion 18 may comprise, on its exterior surface, a first snap-fastening bead 19 adjacent to the transverse wall 11 and a second snap-fastening bead 20 arranged near the free edges of each of the skirt portions 18.

On its surface facing away from the passages 14 and 15, the transverse wall 11, which may be substantially centered along the major axis of its cross section, for example, may comprise two grooved zones 21 and 22, the function of which will be explained in detail later.

The mounting member 10 also may be obtained by injection molding of a thermoplastic material, or by other suitable methods and materials.

The dispensing member 30 may have, in cross section, near its base, a similar cross section to the mounting member 10. Practically midway up its height, the dispensing member 30 may form two shoulders 33 and 34 centered on the major axis of the cross section of its rectangular base. The outer surface of each of the shoulders 33 and 34 may be ribbed. From the shoulders 33 and 34, toward the dispensing orifice 32 the cross section of the dispensing member 30 may decrease gradually.

On the opposite side of the dispensing orifice 32, the dispensing member 30 may be connected to a tamper-proofing strip 31 of cross section similar to the cross section of the mounting member 10.

The dispensing orifice 32 may communicate with a first end of each of two tubular elements 35, 36 which may be substantially aligned along the minor axis of the cross section of the base of the dispensing member 30.

The tubular elements 35 and 36 may have free ends having a crenellated edge 37 and 38. The external cross section of the tubular elements 35 and 36, and their length, may be such that they can be inserted inside the flow passages 52 and 52' of the inserts 50 and 50', respectively. Their crenellated edges 37 and 38 may engage, once the tamper-proofing strip 31 has been removed, with the upper edge of the stoppers 59 and 59' so as to uncover the flow passages 52 and 52'.

The interior surface of the side wall of the dispensing member 30 may comprise, near its edge adjacent to the tamper-proofing strip 31, a peripheral bead 39 able, as can be seen in FIG. 3A, to cooperate in a snap-fastening relationship with the peripheral bead 20 of the mounting member 10 once the tamper-proofing strip has been removed. In this configuration, a bead 40 formed near the lower edge of the tamper-proofing strip 31 may engage in a snap-fastening manner with the bead 19 of the mounting member 10.

Figure 4A:
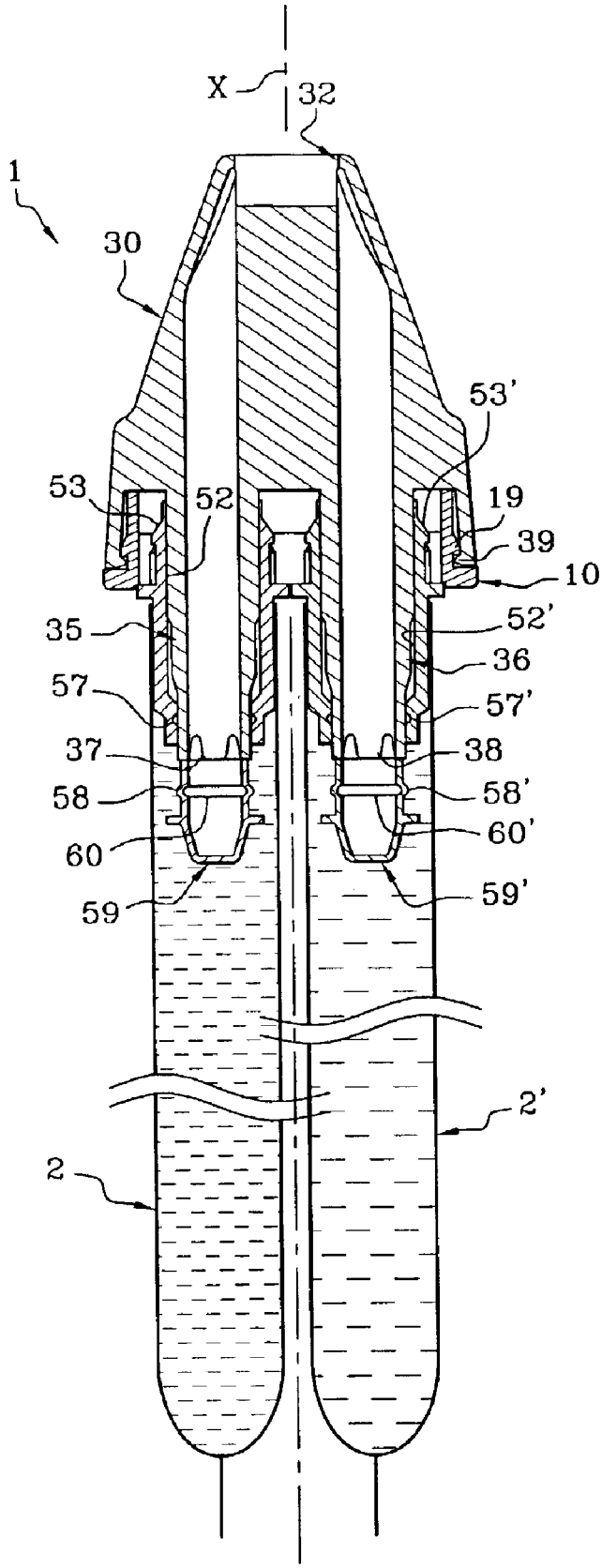
FIG. 4A is a schematic sectional view of the device of FIG. 1 in the dispensing position.

As can be seen in FIG. 4A, after first tearing the tamper-proofing strip 31 off, pressure exerted axially on the dispensing member 30 may cause the latter to move axially and the bead 39 of the dispensing member 30 to engage with the bead 19 of the mounting member 10. In an exemplary embodiment, the catching force between the beads 39 and 19 may be such that, unless a force that is out of proportion with the normal conditions of use is exerted, the snap-fastening between the beads 39 and 19 cannot be detached.

A sectional view of the device 1 in the closed position is depicted in FIG. 3A. In this position, the inserts 50, 50' are as depicted in FIG. 3B. A sectional view of the device in the dispensing position is depicted in FIG. 4A. In this position, the inserts 50, 50' are as depicted in FIG. 4B.

FIGS. 5A–5E illustrate exemplary stages in filling the device described in the preceding figures.

Figure 5C:
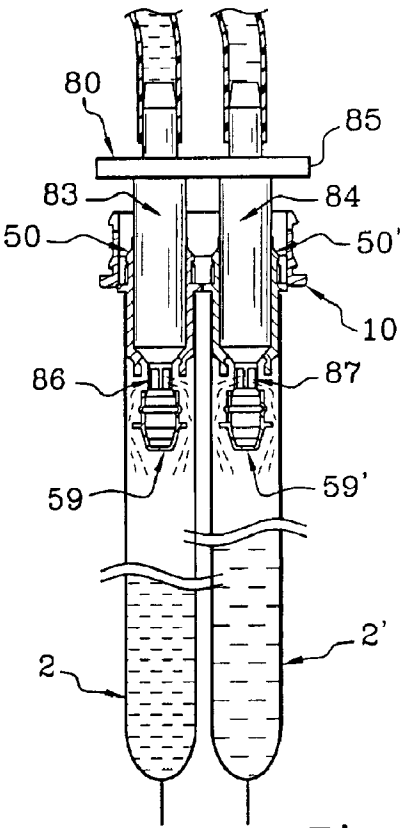
FIGS. 5A–5E are schematic sectional views showing various exemplary stages of filling containers of the dispensing device.
Figure 5B:
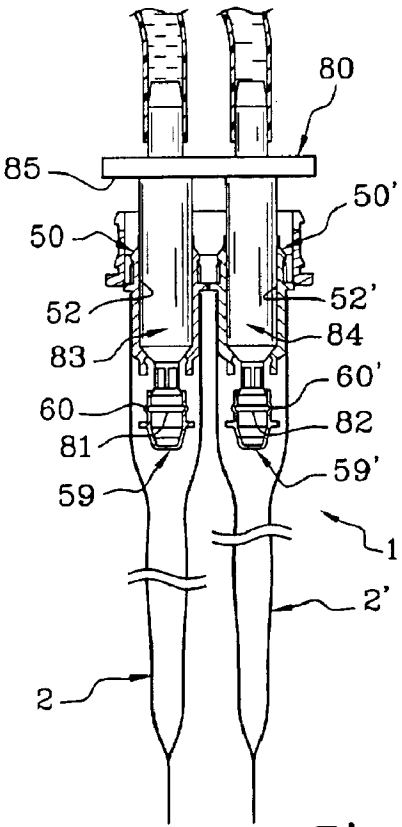
Figure 5A:
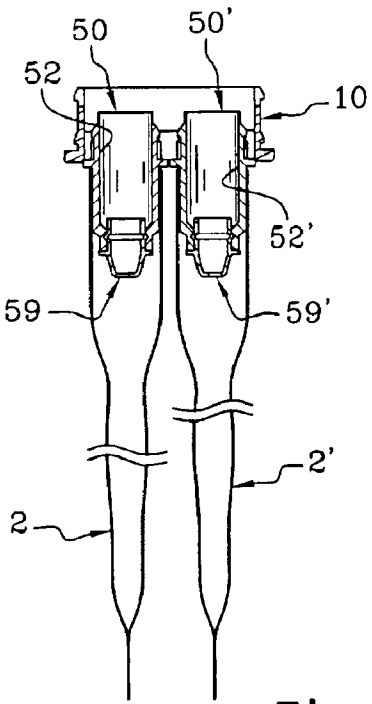

As shown in FIG. 5A, the sachets 2 and 2' equipped with their inserts 50 and 50' may be mounted on the mounting member 10. At this stage, the inserts 50 and 50' are in the configuration of FIG. 3B in which the stoppers 59 and 59' plug the lower ends of the passages 52 and 52'. These passages therefore are not in flow communication with the sachets 2 and 2'.

In FIG. 5B, a filling tool 80, for example, comprising two tubular pipes 83, 84 held an appropriate distance apart by a separator 85, may be engaged with the device 1. During this engagement, the pipes 83 and 84 may be introduced into the passages 52 and 52' until the tips of the filling pipes engage in the stoppers 59 and 59'. At that moment, a bead 81, 82 formed by the filling tubes may engage in a snap-fastening relationship with the grooves 60 and 60' of the stoppers 59 and 59'.

By continuing to exert axial pressure by means of the filling pipes 83, 84, the stoppers 59 and 59' may disengage from the passages 52 and 52'. Flow communication between the filling tubes 83 and 84 and the sachets 2 and 2' may then be established.

In FIG. 5C, the first and second products conveyed via the filling tubes 83 and 84, respectively, may be introduced into the sachets 2 and 2' via the orifices 86 and 87 of the filling tubes 83 and 84, and this may be continued until these sachets are completely full with the first and second products, respectively.

After filling, the filling tubes 83 and 84 may be withdrawn with an axial movement in the opposite direction to the sachets 2, 2'. As this occurs, and because of the snap-fastening between the beads 81 and 82 of the filling tubes 83, 84 and the grooves 60 and 60' of the stoppers 59 and 59', the latter may be pulled back up until they are inserted in the passages 52 and 52' of the inserts 50 and 50'. Flow communication between the passages 52 and 52' and the sachets 2 and 2' may thus be interrupted. This position is illustrated in FIG. 5D.

Figure 5E:
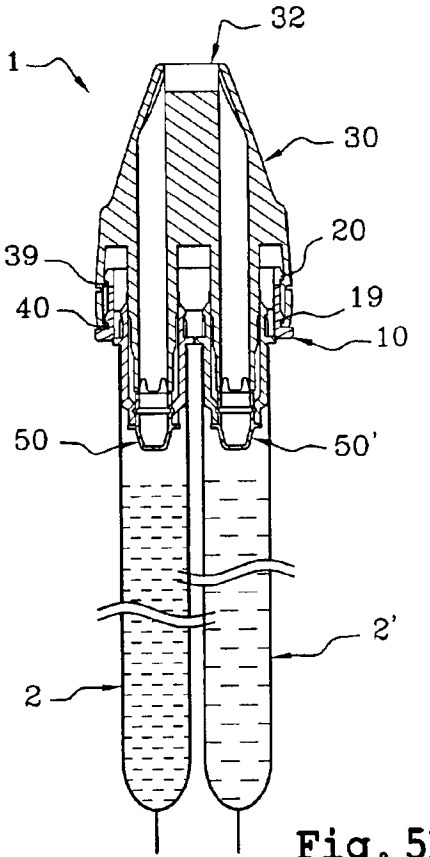
Figure 5D:
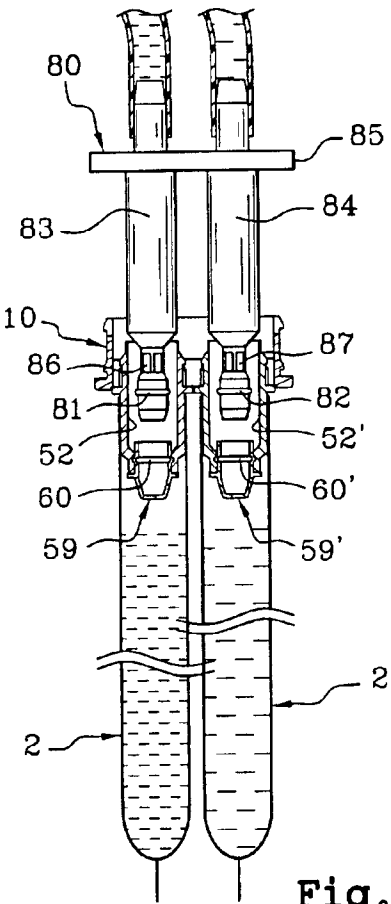

As shown in FIG. 5E, the dispensing member 30 may then be mounted on the mounting member 10 by snap-fastening of the beads 39 and 40 of the dispensing member 30 with the beads 19 and 20 of the mounting member 10.

Figure 6C:
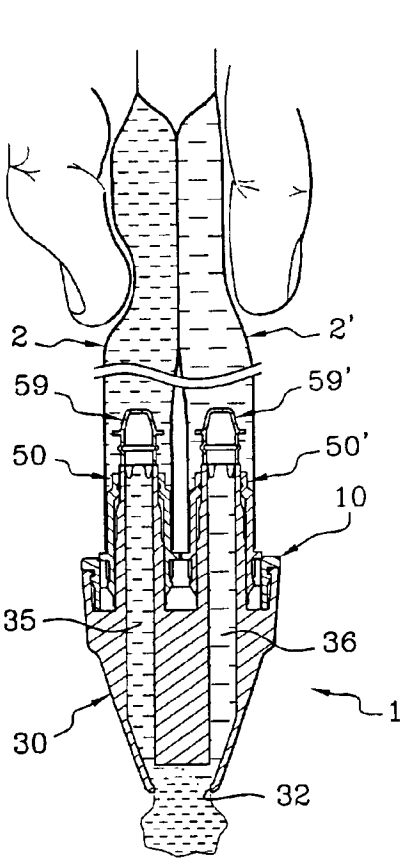
FIGS. 6A–6C are schematic sectional views of the dispensing device of FIG. 1 in various stages of use according to an exemplary aspect.
Figure 6B:
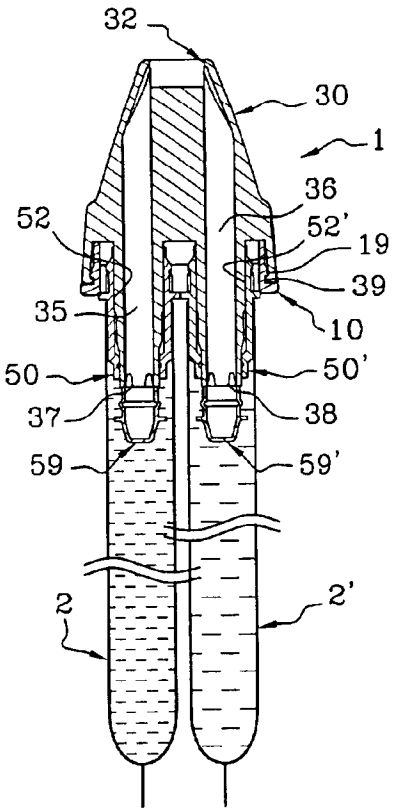
Figure 6A:
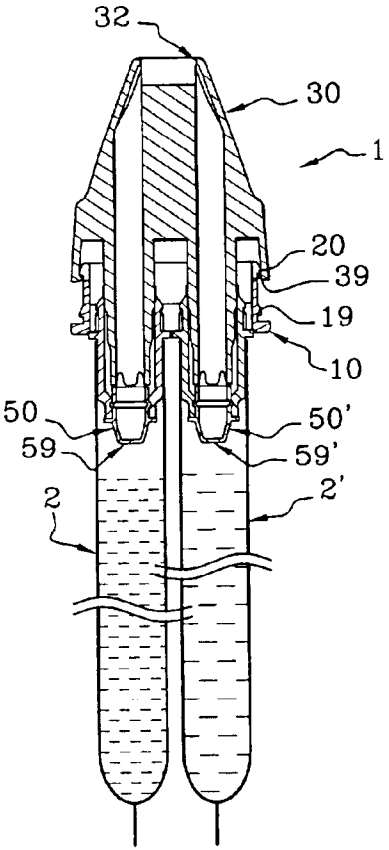

FIGS. 6A–6C illustrate exemplary stages of using the device 1 which has just been described hereinabove.

As shown in FIG. 6A, the tamper-proofing strip 31 of the dispensing member 30 may first be torn off. As shown in FIG. 6B, by grasping the device in both hands (not shown) between the ribbed zones 33, 34 of the dispensing member 30, and the ribbed zones 21, 22 of the mounting member 10, the user may push the dispensing member 30 down until the bead 39 engages with the bead 19 of the mounting member 10.

As this occurs, the crenellated edge 37 and 38 of the tubular portions 35 and 36 of the dispensing member 30 may abut against the free edge of the stoppers 59 and 59' until it causes them to disengage from the passages 52 and 52'. Flow communication between the dispensing orifice 32 and the sachets 2 and 2' may thus be established. This configuration of the device corresponds to the one depicted in section in FIG. 4A.

In this configuration (i.e., the second, open configuration) an annular seal between the external surface of the tubular portions 35 and 36 of the dispensing member 30 and the internal wall of the flow passages 52, 52' of the sachets 2, 2' may be formed using a bead/groove arrangement.

Due to the unidirectional engagement of the tubular portions 35 and 36 with the stoppers 59 and 59', any repositioning of the stoppers 59 and 59' into their first position in which they isolate (i.e., prevent flow communication) the sachets 2 and 2' from the dispensing orifice 32, becomes impossible. Indeed, even if the user were to manage to unfasten the beads 39 of the dispensing member from those 19 of the mounting member 10, making it possible for the dispensing member 30 to be withdrawn from the mounting member 10, this would not cause the stoppers 59 and 59' to be repositioned so as to prevent flow communication between the passages 52, 52' and the dispensing orifice 32, as the ends 37, 38 of the tubular portions would disengage from the stoppers 59, 59'.

As shown in FIG. 6C, the user may invert the device over a container or other surface at which mixing is to be performed. Once inverted, the user may squeeze the sachets 2 and 2' between his or her hands so as to cause the two products to leave, together, through the dispensing orifice 32 via the tubular portions 35 and 36 of the dispensing member, for example, until the contents of the two sachets 2, 2' have been completely emptied.

Alternatively, the two products may be dispensed together directly onto the hair (e.g., locks of hair) that are to be colored, the dispensing member 30 in this case being used as an applicator nozzle, for example.

In the foregoing detailed description, reference was made to some exemplary embodiments of the invention. These can be varied without departing from the scope and operational principles.

In the embodiments shown in the figures, the sachets 2 and 2' are oriented parallel to the plane containing the major axis of the cross section of the mounting member 10. In an alternative, the sachets may be oriented parallel to the plane containing the minor axis of the cross section of the mounting member. This alternative may make the dispensing member 30 easier to move with a view to opening the sachets 2 and 2'. In another alternative, the cross section of the mounting member 10 and of the base of the dispensing member 30 may have some shape other than rectangular, such as circular or oval, for example. Further, the containers may not be flexible, but rather substantially rigid and use of the device may include either pouring the first and second products from the containers or using a piston assembly to push the first and second products from the containers, rather than squeezing the containers to dispense the products.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed is:

1. A device for dispensing a first product and a second product together, the device comprising:

a first container configured to contain the first product;

a second container configured to contain the second product; and a dispensing member defining at least one dispensing orifice, the dispensing member being movable so as to irreversibly switch the device from a first configuration to a second configuration, wherein when the device is in the first configuration, the first container and the second container are not in flow communication with the at least one dispensing orifice, and wherein when the device is in the second configuration, the first container and the second container are in flow communication with the at least one dispensing orifice.

2. The device of claim 1, wherein at least one of the first container and the second container comprises at least one-flexible wall.

3. The device of claim 1, wherein the first container and the second container are flexible-wall containers.

4. The device of claim 1, further comprising a mounting member on which the first container and the second container are mounted.

5. The device of claim 4, wherein the dispensing member is moveable with respect to the mounting member.

6. The device of claim 1, wherein the dispensing member comprises a first portion and a second portion configured, in response to movement of the dispensing member, to move a first closure element associated with the first container and a second closure element associated with the second container so as to place the first and second containers in flow communication with said at least one dispensing orifice.

7. The device of claim 6, wherein the device is configured so that the moving of the first closure element and the second closure element occurs in a unidirectional manner.

8. The device of claim 6, wherein the dispensing member comprises a first tubular element defining a first flow passage in flow communication with the dispensing orifice and a first free end defining the first portion, and the dispensing member further comprises a second tubular element defining a second flow passage in flow communication with the dispensing orifice and a second free end defining the second portion.

9. The device of claim 8, wherein the first free end and the second free end are crenellated.

10. The device of claim 5, wherein the dispensing member and the mounting member are configured to cooperate with one another so as to immobilize the dispensing member at least axially relative to the mounting member when the device is in the second configuration.

11. The device of claim 1, further comprising a tamper indicator for indicating tampering with the device.

12. The device of claim 11, wherein the tamper indicator comprises a non-repositionable element.

13. The device of claim 12, wherein the tamper indicator comprises a tear-off strip.

14. The device of claim 3, wherein the first container comprises a first flow passage through which the first product is configured to flow during dispensing and the second container comprises a second flow passage through which the second product is configured to flow during dispensing.

15. The device of claim 14, further comprising a first closure element configured to close the first flow passage and a second closure element configured to close the second flow passage when the device is in the first configuration.

16. The device of claim 15, wherein the first closure element and the second closure element each comprise a coupling mechanism configured so that, prior to mounting the dispensing member to the device, the coupling mechanism is capable of engaging with a tool for moving the first closure element and the second closure element from a position in which the first container and the second container are in flow communication with the exterior of the device to a position in which the first container and the second container are not in flow communication with an exterior of the device.

17. The device of claim 16, wherein the tool comprises a product filling tool having portions configured to be introduced into the first flow passage and the second flow passage.

18. The device of claim 3, wherein the first container and the second container are in the form of sachets.

19. The device of claim 18, wherein the first container and the second container are formed of at least one layer of a material chosen from a thermoplastic material and a metallic material.

20. The device of claim 1, further comprising a first insert configured to be inserted into the first container and a second insert configured to be inserted into the second container, wherein the first insert defines a first flow passage configured to flow the first product from the first container during dispensing and the second insert defines a second flow passage configured to flow the second product from the second container during dispensing.

21. The device of claim 20, wherein the first insert further comprises a first closure element configured to prevent flow communication between the first container and the dispensing orifice when the device is in the first configuration and wherein the second insert further comprises a second closure element configured to prevent flow communication between the second container and the dispensing orifice when the device is in the first configuration.

22. The device of claim 21, wherein the first closure element and the second closure element are configured to close the first flow passage and the second flow passage when the device is in the first configuration.

23. The device of claim 21, wherein the first closure element is connected to the first insert and the second closure element is connected to the second insert.

24. The device of claim 23, further comprising a first connecting strip configured to connect the first closure element to the first insert and a second connecting strip configured to connect the second connecting strip to the second insert.

25. The device of claim 20, wherein the first container and the second container are mounted on the first insert and the second inserts, respectively, by one of bonding and welding.

26. The device of claim 1, further comprising the first product in the first container and the second product in the second container.

27. The device of claim 26, wherein the first product comprises a first constituent component of a cosmetic composition, and the second product comprises an a second constituent component of a cosmetic composition, and the mixture of the first product and the second product comprises a cosmetic composition.

28. The device of claim 27, wherein the first product comprises an oxidizer, the second product comprises a colorant, and the cosmetic composition comprises a hair coloring composition.

29. The device of claim 1, wherein after the device has been switched from the first configuration to the second configuration, further movement of the dispensing member does not alter the flow communication between the dispensing orifice and the first container and the second container.

30. A method of dispensing a first product and a second product, the method comprising:

providing the device of claim 1, wherein the first product is in the first container and the second product is in the second container;

moving the dispensing member so as to switch the device from the first configuration to the second configuration; and flowing the first product and the second product from the first container and the second container, respectively, and out of the at least one dispensing orifice.

31. The method of claim 30, further comprising at least partially mixing together the first product and the second product.

32. The method of claim 30, further comprising applying the first product and the second product to an external body portion.

33. The method of claim 32, further comprising at least partially mixing together the first product and the second product prior to the applying of the first product and the second product.

34. The method of claim 32, wherein the external body portion comprises at least one of hair and skin.

35. The method of claim 32, wherein the first product comprises a colorant and the second product comprises an oxidizer and the external body portion is hair.

36. The method of claim 35, further comprising at least partially mixing the first product and the second product together to form a hair coloring composition prior to applying the first product and the second product to the external body portion.

37. The method of claim 30, wherein the moving further comprises moving a first closure element associated with the first container and moving a second closure element associated with the second container.

38. The method of claim 37, wherein the moving of the first closure element and the second closure element comprises moving the first closure element and the second closure element in a unidirectional manner.

39. The method of claim 37, wherein the moving of the first closure element and the second closure element comprises moving the first closure element and the second closure element from a first position in which the first and second closure elements prevent flow communication between the dispensing orifice and the first container and the second container, to a second position in which the first and second closure elements place the dispensing orifice in flow communication with the first container and the second container.

40. The device of claim 1, wherein the device is configured to contain the first product in the first container when the device is in the second configuration and to contain the second product in the second container when the device is in the second configuration.

41. The device of claim 1, wherein the device is configured to maintain the first product in the first container separate from the second product in the second container when the device is in the second configuration.

42. A device for dispensing a first product and a second product together, the device comprising:

a first flexible-walled container configured to contain the first product;

a second flexible-walled container external to the first container and configured to contain the second product;

a mounting member configured to be mounted to the first container and the second container; and a dispensing member defining at least one dispensing orifice, the dispensing member being movable so as to irreversibly switch the device from a first configuration to a second configuration, wherein when the device is in the first configuration, the first container and the second container are not in flow communication with the at least one dispensing orifice, and wherein when the device is in the second configuration, the first container and the second container are in flow communication with the at least one dispensing orifice.

43. The device of claim 42, further comprising the first product in the first container and the second product in the second container.

44. The device of claim 43, wherein the first product comprises a first constituent component of a cosmetic composition, and the second product comprises an a second constituent component of a cosmetic composition, and the mixture of the first product and the second product comprises a cosmetic composition.

45. The device of claim 44, wherein the first product comprises an oxidizer, the second product comprises a colorant, and the cosmetic composition comprises a hair coloring composition.

46. The device of claim 42, wherein the device is configured to contain the first product in the first container when the device is in the second configuration and to contain the second product in the second container when the device is in the second configuration.

47. The device of claim 42, wherein the device is configured to maintain the first product in the first container separate from the second product in the second container when the device is in the second configuration.

* * * * *

UNITED STATES PATENT AND TRADEMARK OFFICE

CERTIFICATE OF CORRECTION

PATENT NO. : 6,880,725 B2
DATED : April 19, 2005
INVENTOR(S) : Vincent De Laforcade It is certified that error appears in the above-identified patent and that said Letters Patent is hereby corrected as shown below:

Column 13,
Line 3, delete “an” after -- comprises --.

Signed and Sealed this

Twelfth Day of July, 2005

JON W. DUDAS
*Director of the United States Patent and Trademark Office*